United States Patent [19]

Monsheimer et al.

[11] 4,294,087

[45] Oct. 13, 1981

[54] ENZYMATIC METHOD FOR HAIR RECOVERY WITH CONCURRENT OPENING OF HIDE STRUCTURE

[75] Inventors: Rolf Monsheimer, Darmstadt-Eberstadt; Ernst Pfleiderer, Darmstadt-Arheilgen, both of Fed. Rep. of Germany

[73] Assignee: Röhm GmbH, Darmstadt, Fed. Rep. of Germany

[21] Appl. No.: 136,678

[22] Filed: Apr. 2, 1980

[30] Foreign Application Priority Data

Apr. 28, 1979 [DE] Fed. Rep. of Germany ..... 2917376

[51] Int. Cl.[3] ..... C14C 1/06

[52] U.S. Cl. ..... 69/21; 8/94.15

[58] Field of Search ..... 8/94.15, 94.17, 94.18; 69/23, 24, 28, 21, 22

[56] References Cited

U.S. PATENT DOCUMENTS

| | | | |
|---|---|---|---|
| 2,374,836 | 5/1945 | Ruedebush | 69/21 |
| 3,269,858 | 8/1966 | Mattei | 69/21 |
| 3,471,518 | 10/1969 | Hager | 69/21 |

OTHER PUBLICATIONS

Textile Research J. 30, 1–10 (1960), [Chem. Abstr. 54, 6135].

Textile Research J. 37, 1085–1086 (1967), [Chem. Abstr. 68, 96688h].

Ullmanns Encyclopedia of Tech. Chem., 4th Ed., vol. 12, p. 442.

DE-OS 21 57 034 [Chem. Abstr. 79, 54900t].

French Pat. No. 1,469,512 [Chem. Abstr. 67, 8460].

Technicuir 1974, 8 (7), 12–19 [Chem. Abstr. 82, 32473r].

Austrian Pat. No. 183,540 [Chem. Abstr. 50, 594c].

*Primary Examiner*—Patrick D. Lawson

*Attorney, Agent, or Firm*—Curtis, Morris & Safford

[57] ABSTRACT

What is disclosed is a method for the recovery of hair from an animal hide and for a concurrent opening of the hide structure using a proteolytic enzyme, which method comprises first pre-treating the hide, free of preservative salt, in the acid pH region with a material cleaving disulfide bridges and then, without a previous softening, concurrently loosening hair and opening the hide structure by treating said hide with a protease, effective in the alkaline region, at a pH value of about 11 to about 13.

13 Claims, No Drawings

ENZYMATIC METHOD FOR HAIR RECOVERY WITH CONCURRENT OPENING OF HIDE STRUCTURE

The present invention relates to an enzymatic method for the recovery of hair from animal skins or hides while effecting a concurrent opening of the hide structure in the preparation of leather.

In leather technology, skins and hides are only seldom processed directly after slaughter as so-called "green" skins. For the most part, the skins and hides are first preserved, generally by salting, in order to protect them from microbiologic decomposition during subsequent storage in piles or on shipment, possibly over large distances. The further treatment of the raw hides follows in a series of steps which have been laboriously developed and tested over generations. The salted and dried raw hides are first softened in the beamhouse in order to revert them to a condition similar to that of the "green" hide. After softening, hair loosening in enzymatic processes takes place in a separate bath. Thereafter, dehairing follows, mostly by means of a machine stripping of the hair from the grain. On subsequent alkaline liming, the skin portion which forms the leather swells and thus is opened up for tanning. At the same time, residues of the hair roots and the short hairs are jellified by the addition of a suitable reducing substance such as, inter alia, sodium sulfide or sodium hydrogen sulfide.

In the swollen condition, the subcutaneous connective tissue is removed from the flesh side. Then deliming and bating follow with neutralization whereby, by a decrease in swelling, the swollen skin reaches its natural hydration state and protein materials which have not yet been removed (technically referred to as "scud") and which would unsatisfactorily influence the quality of the leather, are removed.

In contrast to the traditional method in the beamhouse, the teachings of U.S. Pat. No. 3,986,926 have brought about a decisive advance. The patent teaches a one-step enzymatic process for the preparation of tannable dehaired pelts, according to which the course of softening, dehairing, opening of the hide structure, and bating are all encompassed in one working step. According to the method, the hides or skins free of preserving salts are treated at a pH between about 9 and about 12 with (a) an effective amount of at least one protease selected from the group comprising fungus proteases (having a pH optimum versus casein at a value above 7), trypsin, papain, and bacterial proteases having a pH optimum between 6 and 9, (b) an effective amount of a bacterial protease having a pH optimum (versus hemoglobin) at a pH above 9, and (c) an effective amount of a short-chain primary or secondary aliphatic amine, e.g. having a lower alkyl residue, optionally in the further presence of a reducing substance.

The method according to U.S. Pat. No. 3,986,926 gives outstanding leather sorts and contributes significantly to a simplification of the course of treatment in the beamhouse. On the other hand, it does not always offer sufficient assurance that the quality of the hair will not be impaired. The increasing demands for a total ecological balance, also in leather technology, accentuate the desire for a method in which the hair, after dehairing, is also in an optimum state of preservation. Naturally, the requirement persists that the dehaired pelts obtained after such a process not be qualitatively worse than those obtained according to the prior art. However, for reasons of ecology and labor efficiency a renewed breaking up of the process into the traditional single steps of the beamhouse was to be avoided, if possible.

It has been found that the technological requirements can be most widely satisfied if hair recovery is carried out concurrently with an opening of the hide structure in a single method using proteolytic enzymes, wherein hides freed of preservative salts are pre-treated in a first working step in the acid pH region with at least one substance cleaving disulfide bridges, then are brought into an alkaline pH region, and hair loosening and opening of the hide structure are carried out concurrently at a pH value of about 11 to about 13 using proteases which are effective in the alkaline region. In the process, no pre-softening is necessary.

In the first working step, cleavage of the disulfide bridges can be carried out with substances suitable therefor at a pH of 3–6.5, preferably at a pH of 5–6. In general, a treatment time of 2 to 4 hours, preferably at room temperature, has proved fully sufficient.

Suitable substances cleaving disulfide bridges are particularly compounds of the general formula $$R—SH$$

wherein R is alkyl having 2 to 6 carbon atoms, optionally substituted with —OH or —SH, or wherein R is the group $—(CH_2)_n—(CHR_1)—COOH$ and $R_1$ is hydrogen or alkyl having 1 to 6 carbon atoms or is an amino group and n is an integer from 0 to 6, or wherein R is the group $R_2—CO—$ and $R_2$ is alkyl having 1 to 6 carbon atoms. Other compounds for cleaving disulfide bridges are those of the formula $$R'—\underset{\underset{NH_2}{|}}{C}=S,$$

wherein R′ is hydrogen, alkyl having 1 to 6 carbon atoms, or amino.

Mercaptoethanol, thioglycolic acid, thioacetic acid, thiourea, thioformamide, thioacetamide, and cysteine, the latter usually in the form of an acid addition salt, are, among others, particularly to be mentioned as substances which cleave disulfide bridges and which can be used alone or in combination.

The substances cleaving disulfide bridges are generally used in amounts which are 0.1 to 5 percent, preferably 0.2 to 2.0 percent, by weight of the raw goods (salt weight) being treated.

In the first method step, the concurrent use of hydrotropic agents, in concentrations which are in the same region as those for the substances cleaving disulfide bridges, is preferred.

Hydrotropic agents (see F. Strather, in "Gerbereichemie und Gerbereitechnologie", 4th Edition, Akademie-Verlag, Berlin, 1967, page 87) are substances exhibiting the property of hydrotropy, that is the inherent ability of the substances to render water-soluble or water-swellable, or emulsifiable, other materials which would otherwise be insoluble or difficultly soluble in water [cf. C. Neuberg, Biochem, Zeitschr. 107 (1916)]. To a certain extent this activity coincides with the ability of the hydrotropic agents to break hydrogen bonds.

As hydrotropic agents, formamide, acetamide, calcium chloride, thiocyanates, sulfonic acids, and carboxylic acids of aromatic and aliphatic compounds, and, further, surface-active substances are mentioned [cf. H. Rath et al., in Melliands Textilber. 43 (7), 718 (1962)], particularly, however, urea. Urea is advantageously used in concentrations from 0.1 to 5 percent, preferably 0.1 to 2 percent, by weight of the raw goods (salt weight).

Adjustment into the alkaline pH region, suitably into the pH region from 11 to 13, and preferably from 11.5 to 12.5, can be carried out in the usual way, for example by the addition of alkalis such as sodium hydroxide or potassium hydroxide, or sodium or potassium carbonate.

The subsequent enzymatic method step can, for example, be carried out at room temperature or at elevated temperatures, with the reaction times being suitably conformed therewith. In general, the enzymatic step is carried out between 18° C. and 28° C., in which case the reaction times in general are between 12 hours and 36 hours, and predominantly between 16 and 24 hours.

As enzymes, those enzymes which are effective in the aforementioned alkaline pH region are used, and are essentially proteases having a pH optimum and a corresponding stability in the alkaline pH region. The proteases which can be used with advantage according to the invention preferably have their pH optimum above a pH value of 9, essentially in the pH region between 9 and 12.

The serine proteases are particularly suitable for the method according to the present invention, i.e. that group of animal and bacterial endopeptidases having a catalytically active serine residue in the active center [cf. Lexikon Biochemie, Verlag Chemie, pages 512–513, Weinheim, Germany, 1976], and particularly the serine proteases of bacterial origin, but also thiol proteases. Above all, the proteases from Bacillus types, such as *B. subtilis, B. licheniformis, B. firmus, B. alcalophilus, B. polymixa,* and *B. mesenthericus* should be mentioned. In general, one can start from an enzyme activity which is between 8,000 and 10,000 Loehlein-Volhard-units (LVU) per gram of enzyme.

In general, the proteases that are effective in the alkaline region are used in the process according to the present invention in amounts which are from 0.1 to 10 percent, preferably from 1 to 5 percent, by weight of the salted hides and skins (raw weight).

In carrying out the process of the present invention, one can proceed in detail as follows:

The process of the present invention not only leads to dehaired pelts of high quality, but it also permits the recovery of hair in an optimum condition. The method is just as economic as it is environmentally felicitous. It can be used as a compact method in which the number of individual technological steps and therewith expenditures for apparatus and the need for space and particularly for time can be reduced to a minimum.

Additives know per se for enzymatic reactions can be used in the method according to the present invention, inter alia materials such as activators and stabilizers. The proteolytic efficacy of enzymes is commonly determined according to the Anson hemoglobin method [M. L. Anson, J. Gen. Physiol. 22, 79 (1939)] or according to the Loehlein-Volhard method ["Die Loehlein-Volhard'sche Methode zur Bestimmung der proteolytischen Aktivitaet", Gerbereichem. Taschenbuch, Dresden-Leipzig, (1955)] and expressed in "LVU" (Loehlein-Volhard-units). One LVU is that amount of enzyme which, under the specific conditions of the method, digests 1.725 mg of casein.

A better understanding of the method and of its many advantages will be had by referring to the following specific examples, given by way of illustration. The percentages refer to the salt weight of the hides.

EXAMPLE 1

100 kg of black variegated salted cow hides are washed for two hours in a vat with 150% by weight of water (30° C. entry temperature) and the bath is then discarded.

Next, in order to loosen hair and open up the hide structure, the hides are treated for two hours with 150% of water (26° C. entry temperature) and 0.2% of thioglycolic acid (85% technical). At the beginning, the hides are turned for 30 minutes at 4 revolutions per minute. The hides are now permitted to stand for 1 hour and then are again agitated for 30 minutes. The pH value of the bath is 5.4.

Subsequently, 1.0 percent of an alkaline bacterial proteinase from *B. subtilis* (9,000 LVU), 2.0 percent of an alkaline bacterial proteinase from *B. Licheniformis* (9,000 LVU), and 2.0% of caustic soda, (previously dissolved 1:5 in cold water) are added and the mixture is agitated for one hour. After this time, the pH value is 13.4.

The total treatment time amounts to 18 hours. During this period, the batch is agitated for five minutes every two hours.

At the end of the treatment, the dehaired pelts are completely free of hair and short hairs. The pelts are washed twice, each time for 20 minutes, with 150% of water at 25° C. before carrying out mechanical processing. Thereafter, the machine steps of fleshing and splitting follow.

EXAMPLE 2

100 kg of red variegated bull hides in the 25–29½ kg weight class are first washed in a vat for two hours with 100% of water (30° C. entry temperature). At the beginning and again at the end of the treatment, the hides are agitated for 20 minutes at 3–4 rpm. The pH value of the wash water is 8.0. Thereafter, the bath is discarded.

For loosening hair and opening the hide structure, the hides are treated with 100% of water (28° C. entry temperature), 0.3% of thioacetic acid, and 0.3% of urea for two hours. At the beginning and again at the end, the hides are agitated for a 30 minute period.

Now, 0.6% of an alkaline bacterial proteinase from *B. firmus* (9,000 LVU) 1.5% of an alkaline bacterial proteinase from *B. alcalophilus* (9,000 LVU), 3.0% of hydrated lime, and 1.0% of caustic soda, previously dissolved 1:5 in cold water, are added and the batch is agitated for one hour. After agitation a pH value of 13 is measured.

The total treatment time is 18 hours. During this period the hides are agitated at 3–4 rpm for periods of 10 minutes at 3 hour intervals.

Subsequently, the pelts are taken from the vat. They are dehaired, fleshed, and split by machine.

The pelts are uniformly dehaired and have flat fat wrinkles and show no contraction of the grain.

EXAMPLE 3

100 kg of salted calf skins are treated in a vat for two hours with 150% of water (26° C. entry temperature), 0.1% of thioglycolic acid, and 0.1% of mercaptoethanol. During the process, the hides are agitated for 30 minutes of every hour. The pH value at the end of the treatment is 6.5.

Thereafter, loosening of hair and opening of the hide structure are initiated in the same bath with 2.0% of an alkaline bacterial proteinase from *B. mesentericus* (9,000 LVU), 1.0% of an alkaline bacterial proteinase from *B. polymixa* (9,000 LVU), 1.0% of calcium chloride, and 1.5% of caustic soda, dissolved 1:5 prior to use. The bath is now agitated for 1 hour and then permitted to stand for one hour.

The total treatment time is 20 hours. During this time, the batch is turned four times, each time for a period of ten minutes.

At the end of the treatment, the pelts are free of hair and short hairs. After deliming and pickling, they can be tanned directly in conventional fashion with chromium (III) salts.

Bating is no longer required.

EXAMPLE 4

100 kg of ox hides are first washed for removal of preservative salt. The pH value of the wash water is 8.0.

To loosen hair and for opening the hide structure, they are treated for two hours in a vat with 150% of water (25° C. entry temperature), 0.1% of thioglycolic acid, and 0.1% of thiourea. At the beginning, the batch is turned for one hour at 3–4 rpm. Thereafter, the batch is permitted to stand for one hour. Before addition of the enzymes, a pH value of 6.5 is measured.

To the same bath are added 3.0% of an alkaline bacterial proteinase from *B. subtilis* (9,000 LVU) and 2.0% of caustic soda, previously dissolved 1:5 in cold water. The resulting bath is then agitated for one hour. After addition of the enzymes and caustic soda, a pH value of 13 is measured.

The total treatment time is 20 hours. During this period, the batch is agitated for 10 minutes every third hour.

The pelts are free of hair and short hairs. They are smooth and have no grain contraction.

After the mechanical steps of fleshing and splitting, and after deliming and pickling, the hides can be directly tanned with chromium-III-salts.

EXAMPLE 5

100 kg of cow hides are first washed with 100% of water for two hours. At the beginning, the batch is agitated for 30 minutes. Subsequently, the batch is left to stand for one hour. Before discarding the wash water, the batch is again agitated for 30 minutes. The pH value of the bath prior to discard is 8.0.

For carrying out the combined hair loosening and opening of the hide structure, the hides are treated for two hours in a mixer with 100% of water (25° C. entry temperature) and 2.0% of cysteine hydrochloride. At the beginning, the batch is agitated for 30 minutes. After standing for one hour, the batch is again agitated for 30 minutes. The pH value of the solution is 2.8.

To the same bath are now added 3.0% of an alkaline bacterial proteinase from *B. alcalophilus* (9,000 LVU), 1.0% of caustic soda, previously dissolved in a ratio of 1:5 with cold water, and 3.0% of calcium hydrated lime. The batch is agitated for one hour. The pH value of the batch is now 12.4.

The total treatment time is 20 hours. During this time, the batch is agitated for 10 minutes every third hour.

After washing twice as described in Example 1, the pelts are dehaired. They are then fleshed. They are free of hair and short hairs.

EXAMPLE 6

100 kg of "GRASSERS" are first washed in a tanning machine for two hours with 80% of water (30° C. entry temperature). At the beginning, the batch is agitated for 30 minutes and then left to stand for one hour. Before discarding the bath, the batch is agitated again for 30 minutes. The pH value of the bath prior to discard is 7.8.

For hair loosening and opening of the hide structure, 80% of water (25° C. entry temperature) and 1.0% of mercaptopropionic acid are added. The batch is agitated for 30 minutes at the beginning. It is then left to stand for one hour. Before further work, the batch is again agitated for 30 minutes. The pH value of the bath is now 4.3.

To the same bath are now added 3.0% of an alkaline bacterial proteinase from *B. licheniformis* (9,000 LVU), and 2.5% of caustic soda, previously dissolved with water in a ratio of 1:5. The batch is agitated for one hour. The pH value of the bath is now 12.9. During the night, the batch is agitated three times for ten minute periods. The next morning, the bath is discarded.

The hides are next washed with 80% of water (25° C. entry temperature) by agitating for 20 minutes. The washing process is repeated one or two more times.

Subsequently, the pelts are dehaired.

What is claimed is:

1. A method for the recovery of hair from an animal hide and for a concurrent opening of the hide structure using a proteolytic enzyme, which method comprises first pretreating the hide, free of preservative salt, in the acid pH region with a material cleaving disulfide bridges and then, without a previous softening, concurrently loosening hair and opening the hide structure by treating said hide with a protease, effective in the alkaline region, at a pH value of about 11 to about 13.

2. A method as in claim 1 wherein said protease is a serine protease.

3. A method as in claim 1 wherein said material cleaving disulfide bridges is a compound of the formula $$R—SH$$

wherein R is alkyl having 2–6 carbon atoms and optionally substituted with —OH or —SH, or wherein R is the group $—(CH_2)_n—(CHR_1)—COOH$ and $R_1$ is hydrogen or is alkyl having 1 to 6 carbon atoms or is amino and n is a whole number from 0 to 6, or wherein R is a group $R_2—CO$ and $R_2$ is alkyl having 1 to 6 carbon atoms, or said material is a compound of the formula $$R'—\underset{\underset{NH_2}{|}}{C}=S$$

wherein R' is hydrogen, alkyl having 1 to 6 carbon atoms, or amino.

4. A method as in claim 3 wherein said cleaving disulfide bridges material is at least one member selected from the groups consisting of mercaptoethanol, thioglycolic acid, thioacetic acid, thiourea, and cysteine.

5. A method as in claim 1 wherein said material cleaving disulfide bridges is present in an amount from 0.1 to 5 percent of the salt weight of the hides being treated.

6. A method as in claim 1 wherein a hydrotropic agent is additionally present during the pre-treatment, in addition to the material cleaving disulfide bridges.

7. A method as in claim 6 wherein said hydrotropic agent is urea in a concentration from 0.1 to 5 percent of the salt weight of the hides being treated.

8. A method as in claim 1 wherein, after the acid pre-treatment, the pH is adjusted by the addition of alkali to a value between 11 and 13 and hair loosening and opening of the hide structure and concurrently induced in this pH region by the use of a protease effective in the alkaline region.

9. A method as in claim 2 wherein said serine protease has a pH-activity optimum above pH 9.

10. A method as in claim 9 wherein said serine protease can be obtained from a Bacillus type.

11. A method as in claim 10 wherein said serine protease is obtained from *B. subtilis, B. licheniformis, B. firmus, B. alcalophilus, B. polymixa,* or *B. mesenthericus.*

12. A method as in claim 9 wherein said serine protease has an activity between 8,000 and 10,000 LVU per gram of enzyme.

13. A method as in claim 1 wherein said protease effective in the alkaline region is employed in an amount from 1 to 5 percent of the salt weight of the hides being treated.

* * * * *